US008376870B2

(12) United States Patent
Chung

(10) Patent No.: US 8,376,870 B2
(45) Date of Patent: Feb. 19, 2013

(54) GAME TABLE WITH POP-UP SCORING UNIT AND TOUCH SCREEN FOR GAME CONTROLS

(75) Inventor: Safari Chung, Taipei (TW)

(73) Assignee: Indian Industries, Inc., Evansville, IN (US)

( * ) Notice: Subject to any disclaimer, the term of this patent is extended or adjusted under 35 U.S.C. 154(b) by 632 days.

(21) Appl. No.: 12/202,785

(22) Filed: Sep. 2, 2008

(65) Prior Publication Data

US 2010/0056287 A1 Mar. 4, 2010

(51) Int. Cl.
*A63F 9/24* (2006.01)

(52) U.S. Cl. ..... 473/10

(58) Field of Classification Search ..... 273/108.1; 473/10

See application file for complete search history.

(56) References Cited

U.S. PATENT DOCUMENTS

| | | | | |
|---|---|---|---|---|
| 4,017,078 | A | 4/1977 | Goldfarb et al. | |
| 4,093,223 | A | 6/1978 | Wilke et al. | |
| 4,557,694 | A | 12/1985 | Nelson | |
| 4,765,622 | A | 8/1988 | Rienzo | |
| 4,872,679 | A | 10/1989 | Bohaski et al. | |
| 5,096,271 | A * | 3/1992 | Portman | 312/7.2 |
| 5,158,290 | A | 10/1992 | Norris et al. | |
| 5,356,135 | A * | 10/1994 | Montgomery | 473/434 |
| 5,702,308 | A | 12/1997 | Alexander, Jr. | |
| 5,719,548 | A | 2/1998 | Stirling et al. | |
| 5,821,872 | A | 10/1998 | Brown et al. | |
| 5,931,465 | A | 8/1999 | Miyake et al. | |
| 6,349,939 | B1 | 2/2002 | Tsai | |
| 6,502,819 | B2 | 1/2003 | Rieber et al. | |
| 6,534,649 | B1 * | 3/2003 | Denat et al. | 540/452 |
| 6,773,010 | B2 | 8/2004 | Zucchi et al. | |
| 7,219,892 | B2 | 5/2007 | Corrado | |
| 7,364,505 | B2 | 4/2008 | Mattice et al. | |
| 2001/0018882 | A1 | 9/2001 | Recknagel et al. | |
| 2004/0074129 | A1 | 4/2004 | Carlson | |
| 2005/0167908 | A1 | 8/2005 | Nally et al. | |
| 2005/0253505 | A1 | 11/2005 | Braak et al. | |
| 2007/0075487 | A1 | 4/2007 | Silva | |
| 2007/0164510 | A1 | 7/2007 | Chen | |
| 2008/0111310 | A1 * | 5/2008 | Parvanta | 273/309 |
| 2009/0302533 | A1 * | 12/2009 | Smith | 273/108.1 |
| 2010/0061093 | A1 | 3/2010 | Janssen et al. | |

FOREIGN PATENT DOCUMENTS

JP 11-319185 A 11/1999

OTHER PUBLICATIONS

Kasahara, Apr. 8, 2011, JPH11-319185A, Machine Translation.

* cited by examiner

*Primary Examiner* — Michael Dennis
(74) *Attorney, Agent, or Firm* — Woodard, Emhardt, Moriarty, McNett & Henry LLP

(57) ABSTRACT

A game table has a game playing surface and a railing extending around the perimeter of the game playing surface. The railing extends at least slightly above the game playing surface to prevent escape of a game playing piece from the game playing surface and has a top surface. The game table includes a score display unit having a display screen, the display unit being at least partially mounted within the railing. The display screen is moveable between a first flat or hidden position and a second observable display position. At the display position, at least part of the display screen is projected above the top surface of the railing.

20 Claims, 5 Drawing Sheets

GAME TABLE WITH POP-UP SCORING UNIT AND TOUCH SCREEN FOR GAME CONTROLS

FIELD OF THE DISCLOSURE

The present disclosure relates to game tables, and in particular a game table having a pop-up scoring unit and a touch screen for game controls.

BACKGROUND OF THE DISCLOSURE

Watching and participating in sporting events and games is a popular pastime for many people. However, due to time, space and the number of people needed for most such games, it is not always practical to arrange a full-scale game at any particular time. Moreover, due to the skill and physical conditioning required, plus the potential injuries from many such games, individuals are not always prepared to participate in a full-scale game. As a spin-off from full-scale games, recreational game tables such as for table soccer (sometimes called foosball), air hockey, field hockey or similar games have become popular. Game tables allow the participants to simulate a full-sized game with fewer people, less space and in a protected environment. Such games can, for example, be set up in basements, garages, game rooms, backyards, gyms, party facilities or otherwise and are often played with two or four people.

There have been various approaches to designing and constructing game tables for air hockey, table soccer, field hockey, and similar games, as well as the associated game table accessories. Additionally, often when playing these games, each team's score from point to point is merely remembered by each player along with the time elapsed or remaining as corresponds with the game. Although usually a reliable system, if a player is distracted or the player's concentration is broken, it may lead to the player mis-remembering the score or forgetting a time period. Conversely, if a player is concentrating on the score or time, it may distract the player's attention from the game in progress. In the past, attempts to display the score and time for similar table games have involved bulky and/or complex manual or electric components associated with the table. Such displays frequently take additional game-playing space, physically interfere with the game-playing area and/or are difficult for the players to read. This can distract players and interfere with game play. Accordingly, there is a need for an improved method of displaying the score, time periods, and/or other information for table games.

The present disclosure addresses these needs, among others.

SUMMARY OF THE DISCLOSURE

In certain embodiments, a game table has a game playing surface and a railing extending around the perimeter of the game playing surface. The railing extends at least slightly above the game playing surface to prevent escape of a game playing piece from the game playing surface and has a top surface. The game table includes a display unit having a display screen, the display unit being at least partially mounted within the railing. The display screen is moveable between a flat position and a display position. At the display position, at least part of the display screen is projected above the top surface.

In certain other embodiments, a game table has a game playing surface and a railing with a top surface. The railing extends around the perimeter of the game playing surface and extends at least slightly above the game playing surface to prevent escape of a game playing piece from the game playing surface. The game table includes a score display unit including a housing member non-movably mounted within the railing and a display member moveably mounted within the housing member. The display member may include a display screen. Additionally, the display member is moveable with respect to the housing to move the display screen between an inset position within the housing and a display position with respect to the railing.

In further embodiments, a game table has at least one surface and includes a game status display unit moveably mounted in the surface. The game status display unit has a display surface moveable between a first storage position where the display surface is positioned flush with or below the surface and a second display position where the display surface projects above the surface.

DESCRIPTION OF THE ILLUSTRATED EMBODIMENTS

Figure 1:
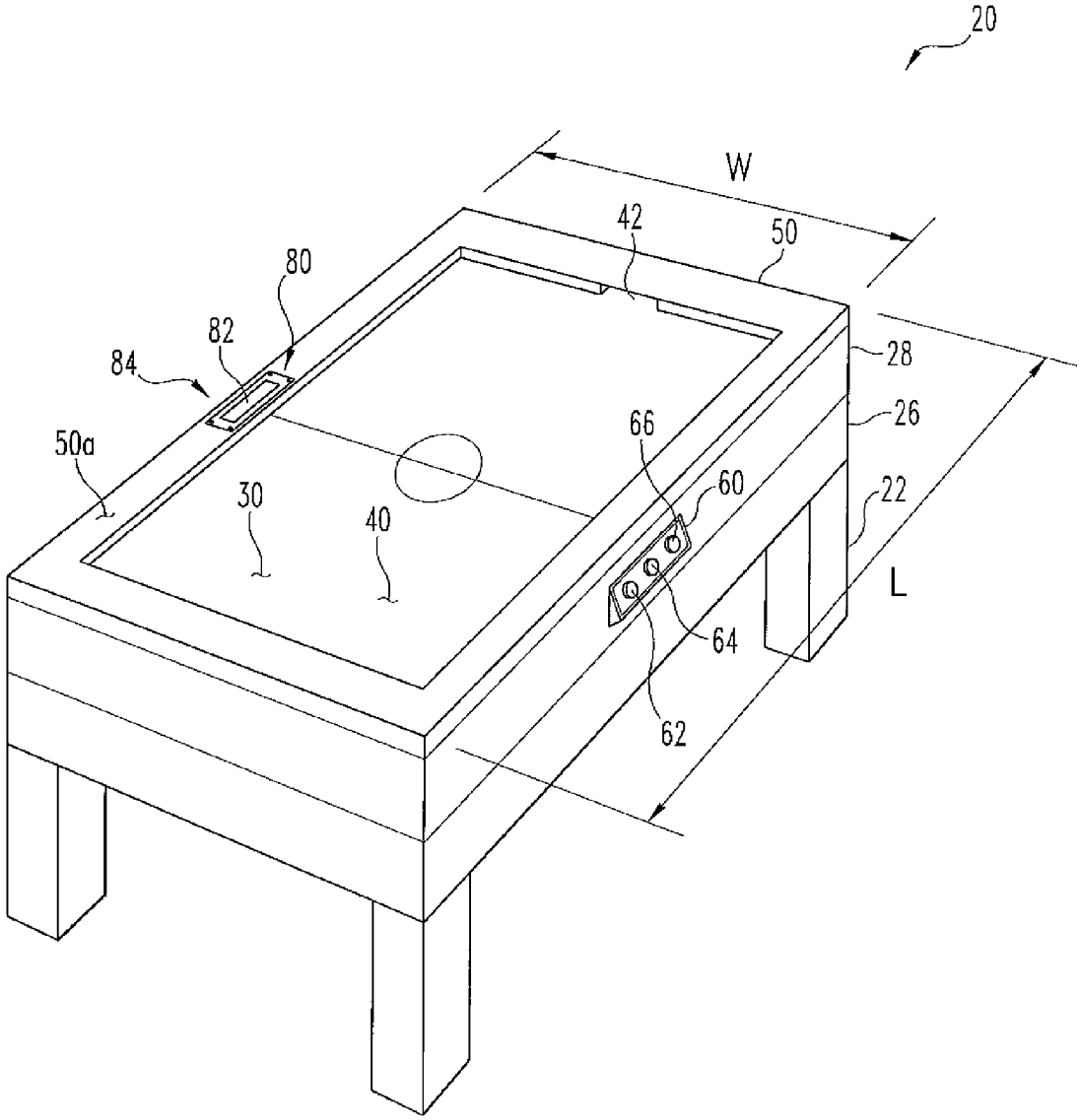
FIG. 1 is a perspective view of a game table, according to an embodiment of the present disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein are contemplated as would normally occur to one skilled in the art to which the disclosure relates.

In certain preferred embodiments of the present disclosure, a game table is provided with improved playing characteristics. The game table may be configured for use with a variety of one or more possible table games such as table soccer (also called foosball), air hockey, field hockey, billiards, and table tennis, as examples. Certain embodiments of the present disclosure include a pop-up score display moveable between a concealed position and a display position where a score display screen is visible to the players. The pop-up score display may be moveable in response to a stimuli, such as when the game table power is turned on. The game table may also optionally include a touch screen control panel for the controls of the game table.

A standard game table includes a playing surface, held over a support surface, such as a floor, by a support structure such as one or more legs or pedestals. The playing surface is often rectangular or round, but may be made in various geometric shapes. The playing surface is also typically substantially flat. In certain embodiments, the playing surface includes elevated or humped corner areas to keep the game piece (typically a ball or puck) in motion. In many instances, the playing surface is surrounded by a peripheral rail, which typically functions to retain game pieces within the area of the playing surface. The game pieces of the present disclosure are usable with various types of games and/or game tables, which are considered conventional for purposes of the present disclosure and are not described herein in detail. Game tables may also include game status indicators, such as score displays and timer displays, mounted to the game tables.

One embodiment of a game table 20 is illustrated in FIG. 1. For illustration and discussion purposes only, the illustrated game table is configured for playing air hockey. However, it should be appreciated that the pop-up scoring unit and touch screen control panel discussed herein can be used with other types of game tables configured for playing other table games. Game table 20 is generally a standard style of game table including four legs 22 supporting a table bed 26. Table bed 26, shown in FIG. 1 in a generally rectangular shape, is the primary superstructure of game table 20. It should be appreciated that table bed 26 can include various shapes as would generally occur to one skilled in the art, including circular, square, or polygonal as examples. Legs 22 are standard support structures for a table, and may, for example, be four corner legs or one or more central pedestals supporting the table bed 26. In preferred embodiments, table 20 includes a frame 28 mounted to the table bed 26. Frame 28 can be a standard frame made of metal, wood, laminate, particleboard, MDF or plastic, and can optionally include rubber or felt bumpers as desired.

Frame 28 includes railings 50 which surround and extend above an upper support surface 30 a height sufficient to block escape of a playing piece from the table. The frame and/or railings can extend up from the table bed and upper support surface a sufficient height as would occur to one skilled in the art, as a design choice for a particular game. In certain embodiments, there are railings 50 disposed on two longitudinal sides of table 20, parallel to a longitudinal length L of the table, and disposed on two player ends of table 20, parallel to a width W of the table. In the particular illustrated embodiment, railings 50 along the ends of table 20 each define a goal 42 configured for passage of a playing piece and that the user on a particular side of the table would be defending. In such cases in which table 20 is configured for playing air hockey, goals 42 are configured for passage of an air hockey puck and the game playing surface may include air holes to allow forced air through the surface.

Game playing surface 40 is configured to be integral with or mounted to frame 28 and includes a shape which matches upper support surface 30. In the illustrated embodiment, game playing surface 40 includes a generally rectangular shape. However, it should be appreciated that the game playing surface can have various shapes, including circular, square, or polygonal as examples. Game playing surface 40 extends across the area defined within frame 28 to form a playing area. The game playing surface is mounted to the frame or extends underneath the lower edges of the frame or railing to eliminate gaps. The game playing surface may rest in place or can be attached using standard methods such as adhesive, friction, screws, bolts or other permanent or removable connectors. The game playing surface is appropriately sized and configured for the desired game. Game playing surface 40 is preferably an appropriately shaped piece of material configured to be mounted over upper support surface 30. Preferred materials for the game surface are a durable plastic (such as a thick polyethylene, Plexiglass®, or Formica®), wood or glass. Additionally, the game playing surface may include appropriate indicia corresponding to the particular table game to be played on the game table.

Game table 20 includes a control pad 60 including at least a power button 62 allowing a user to turn the power to the game table on and off as desired. Control pad 60 may include additional control buttons as would generally occur to one skilled in the art, including as examples a timing button 64 and a restart button 66. In the illustrated embodiment, control pad 60 is centrally located along a longitudinal side of frame 28. However, it should be appreciated that control pad 60 can be positioned elsewhere on game table 20 as would generally occur to one skilled in the art, such as on the ends of the game table and/or on the top or side of one of the railings.

Figure 2:
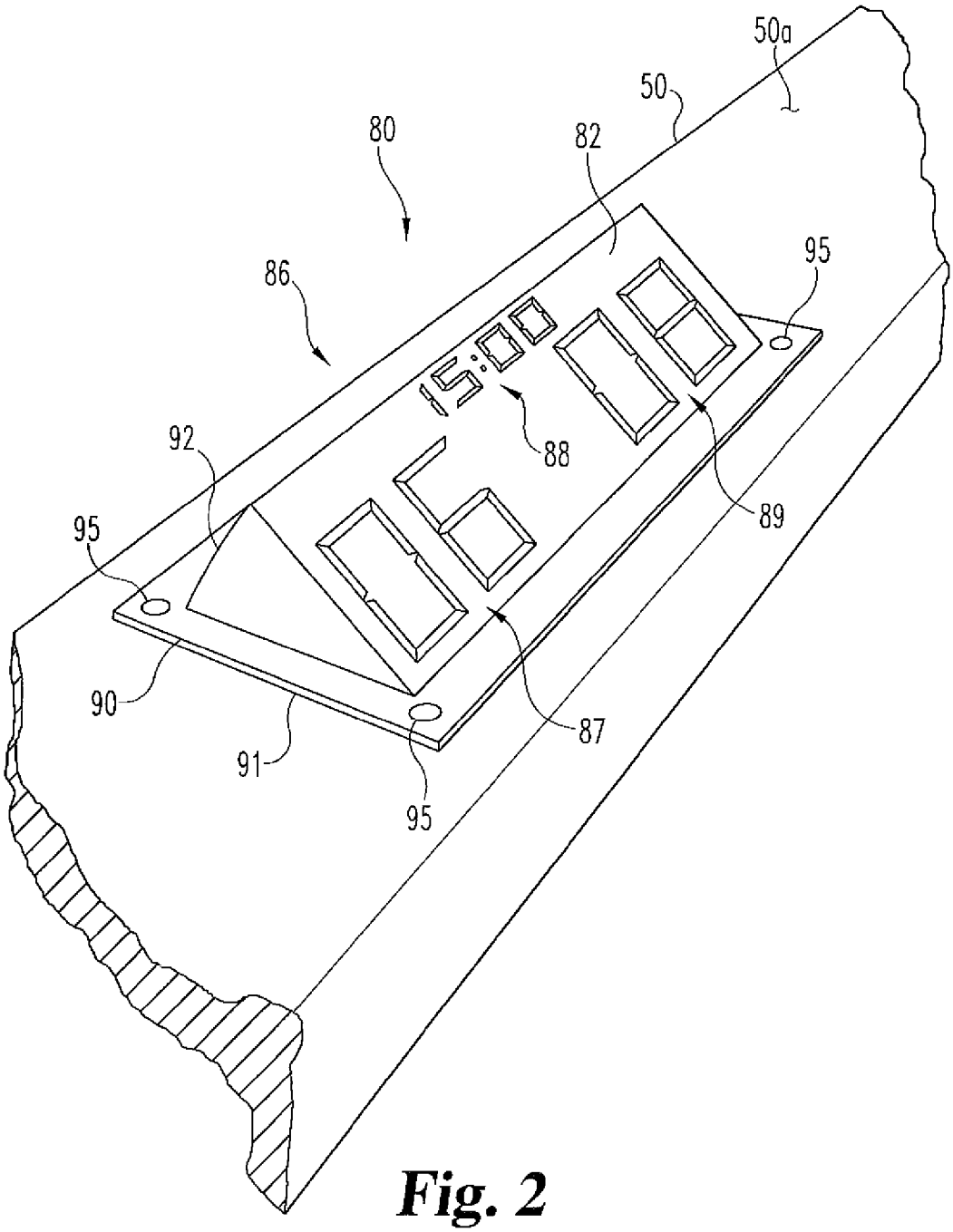
FIG. 2 is a perspective view of a portion of the game table according to the embodiment of FIG. 1.
Figure 3:
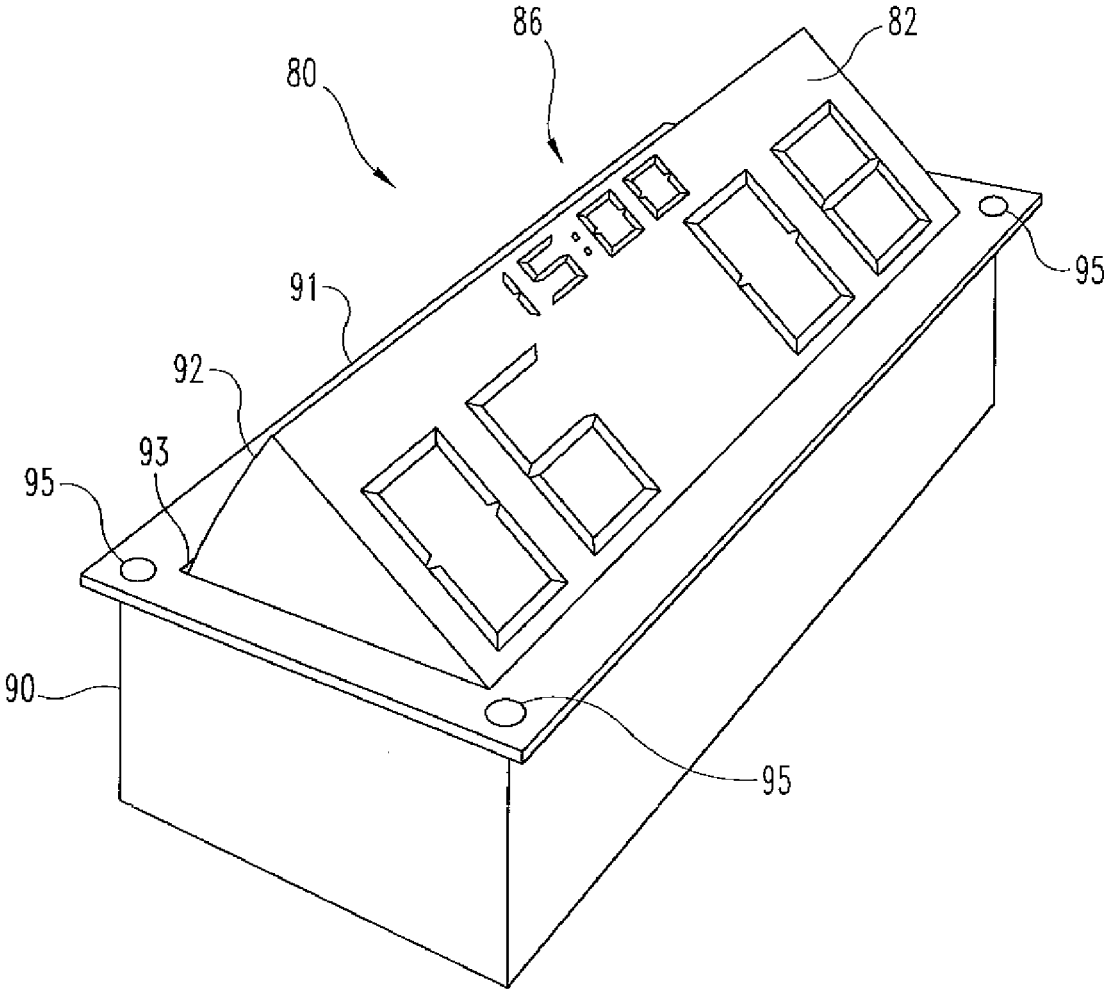
FIG. 3 is a perspective view of a component of the game table according to the embodiment of FIG. 1.

Additionally, game table 20 includes a score display unit 80 having a display screen 82. Display screen 82 is preferably moveable from an inconspicuous, concealed, inset, storage or hidden position 84 (see FIG. 1) to an observable display position 86 (see FIG. 2) so that the players of the game table may more easily view the score of the game. The inset hidden position includes a non-projecting position, with the unit and/or display screen being somewhat shielded or protected, as opposed to the display screen projecting up from the railing. In the inset hidden position, the display screen may not necessarily be fully concealed, and may still be visible to the players. In certain embodiments, in the hidden position the display screen may be parallel or substantially flush with the top surface of the railing. In certain other embodiments, in the hidden position the display screen may be positioned within the railing below the top surface.

In certain embodiments, the display screen is mechanically controlled to move between the different positions in response to a stimuli. The stimuli may be a change in the on/off electrical power status of the game table. In such embodiments, unit 80 may be electrically coupled with at least power button 62 such that display screen 82 moves in response to activation of button 62. In certain embodiments, activation of power button 62 by a user to turn on the game table power functions to activate unit 80 to rotate display screen 82 from hidden position 84 to display position 86. Additionally, activation of power button 62 by a user to turn the game table power off correspondingly activates unit 80 to return display screen 82 to hidden position 84. However, it should be appreciated that other stimuli can be used to direct the movement of the display screen between the hidden and display positions as would generally occur to one skilled in the art. As an example, the display screen may move between the hidden and display positions in response to activation of a button or other mechanism dedicated to directing the movement of the display screen, separate from activation of the on/off power button. As another example, the game table may include sensors which detect movement on the game playing surface or a score, with the display screen moving from the hidden position to the display position in response to notification from the sensors that there is movement on the game playing surface or a score occurs.

Display screen 82 may show one or more different game status indicators. As an example (see FIG. 2), display screen 82 may show the scoring of the game, including player 1 score 87 and player 2 score 89, as well as the timing of the game, illustrated by timer 88. In such embodiments, goals 42 may include sensors associated therewith which are operable to detect passage of a playing piece through the particular goal and send a corresponding electrical signal to unit 80 to increase the score shown on display screen 82. It should be appreciated that the score and timing of the game can be arranged differently on display screen 82 as desired. Additionally, it should be appreciated that the display screen can show only the score display or only the timer display. Further, the display screen could show other game status indicators as would occur to one skilled in the art. As examples, the display screen may show the period of the game, the time elapsed in the period or the game, the possession of the puck, the team names, the high scores, the scoring records, etc.

In hidden position 84, display screen 82 may be substantially flush with or positioned equal to, slightly above or slightly below top surface 50a of railing 50 such that the display screen is substantially parallel to the top surface of the railing. Accordingly, all or a substantial portion of the display unit may be mounted within railing 50. In particular embodiments, display unit 80 includes a housing 90 at least partially mounted within railing 50 and a moveable portion 92 moveable within housing 90. In such embodiments, display screen 82 is positioned on and/or integral with moveable portion 92. As illustrated, housing 90 defines an interior cavity 93 in which moveable portion 92 is positioned and moveable, and optionally includes an upper flange 91 to be used in mounting housing 90 to railing 50. In such cases, railing 50 defines a hole or cavity configured and sized to receive housing 90 therein. In certain embodiments, flange 91 is substantially planar and configured to be positioned on top surface 50*a* of railing 50, and additionally defines four corner mounting holes 95 through a fastener can be inserted to mount housing 90 to railing 50. However, it should be appreciated that score display unit 80 may be mounted to game table 20 via other mounting configurations and methods as would generally occur to one skilled in the art. Display unit 80 may also be mounted to game table 20 at other locations on the game table than as illustrated in FIG. 1. As an example alternative embodiment, there may be two display units, one mounted at each player end of the game table such that the display unit pops up so that the display screen is visible to the player at the opposite player end.

Figure 4A:
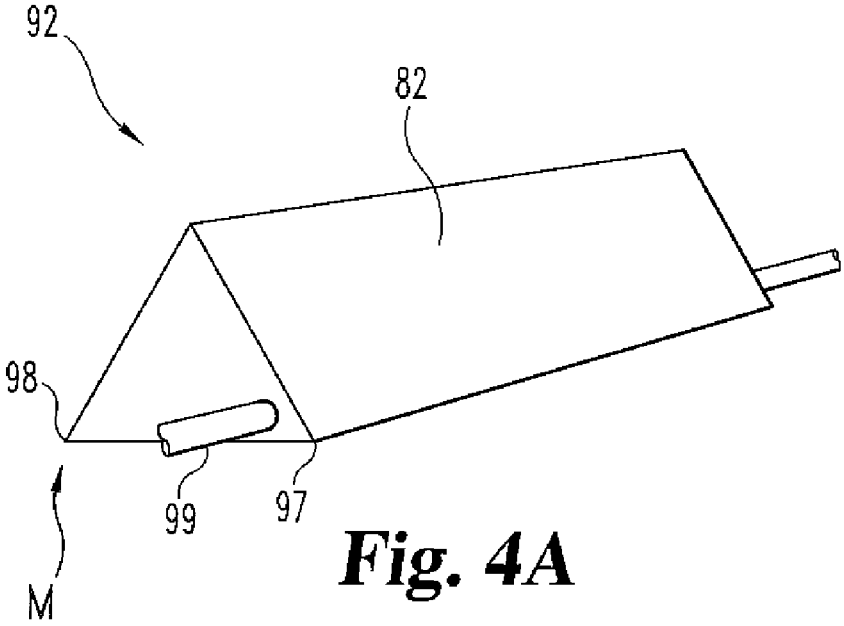
FIG. 4A is another perspective view of a component of the game table according to the embodiment of FIG. 1.

Additionally, it is contemplated that moveable portion 92 may be mounted and moveable within housing 90 via a variety of possible control mechanisms as would generally occur to one skilled in the art. An example is illustrated in FIG. 4A. As illustrated, moveable portion may be connected with housing 90 at least via pivot rod 99. In certain embodiments, pivot rod 99 is a fixed rod and extends through moveable portion 92 such that the moveable portion rotates about the rod. In other embodiments, the pivot rod rotates along with the moveable portion. The pivot rod is positioned at or near corner 97 of the moveable portion, such that the moveable portion pivots about corner 97. The direction of movement of moveable portion 92 within housing 90 from the hidden position to the display position is represented by the M arrow. In certain embodiments, the movement is caused by a force exerted on the moveable portion at or near corner 98 to cause the moveable portion to rotate about the rod.

In other embodiments, portion 92 may be hingedly connected to housing 90 at the bottom edge of screen 82 adjacent corner 97. In such cases, portion 92 may be moved or rotated to the display position by being pushed or lifted up to pivot about the hinged connection. In certain embodiments, a hinge (not shown) may be engaged with portion 92 and connected to housing 90 at or near the bottom edge of display screen 82. However, it should be appreciated that portion 92 may be connected with housing 90 through a variety of appropriate hinged arrangements.

The moveable portion 92 may be moved to create an oblique angle with respect to the top surface of the railing. Accordingly, the top edge of display screen 82 will be positioned higher than the bottom edge of display screen 82. In the illustrated embodiment, moveable portion 90 is moved so that display screen 82 is angled about 45 degrees from flange 91 or top surface 50*a* of railing 50. It should be appreciated that portion 92 may be moved to create a greater or lesser angle than as illustrated. As an example, in other embodiments moveable portion 92 may be moved to create an angle of about 90 degrees.

Figure 4B:
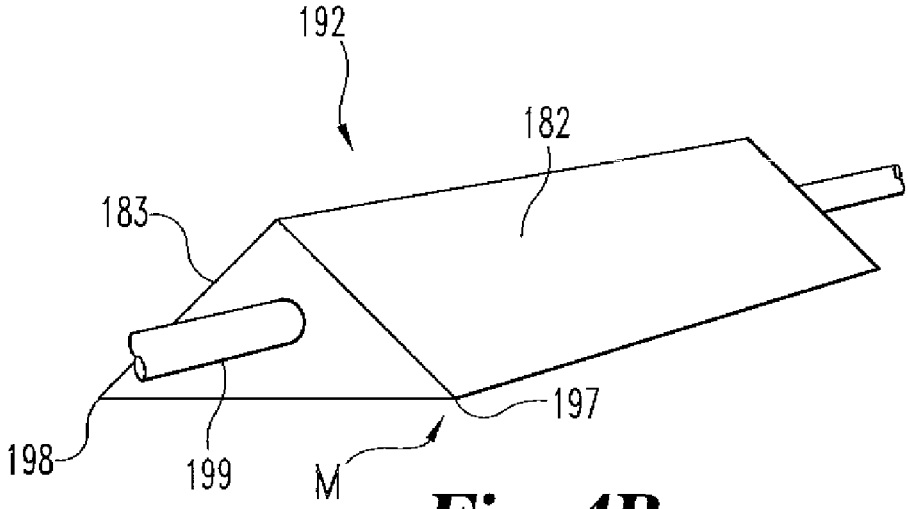
FIG. 4B is a perspective view of a game table component according to another embodiment of the present disclosure.
Figure 5:
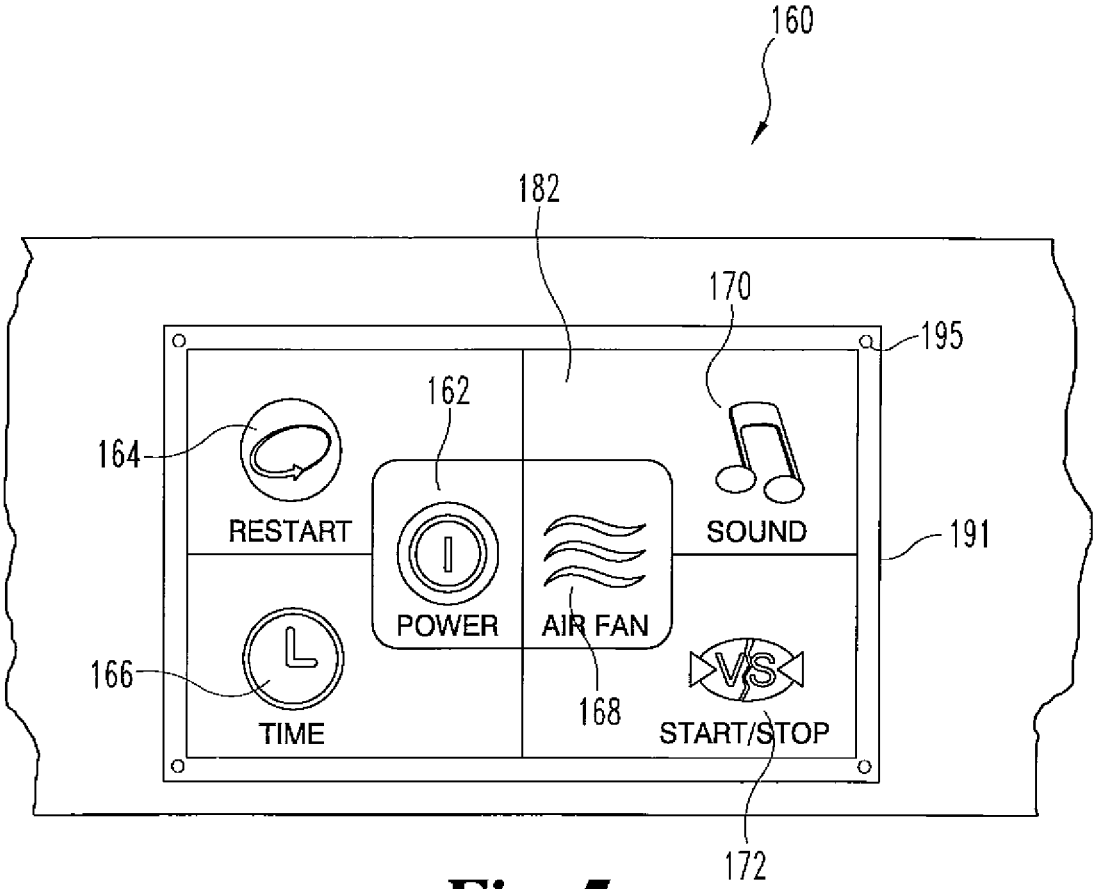
FIG. 5 is a side view of a portion of a game table according to another embodiment of the present disclosure.

An alternative example configuration is illustrated in FIG. 4B. As illustrated, moveable portion 192 is configured to be rotatable in the interior cavity of a housing (not shown) mounted in the railing of a game table, similar to housing 90. Portion 192 is configured such that in the hidden position, display screen 182 faces an interior housing wall defining the cavity and surface 183 faces up from the housing. In certain embodiments, in the hidden position surface 183 can be substantially parallel to or flush with the top surface of the railing. Accordingly, the display screen is inaccessible when in the hidden position. The moveable portion 192 is configured to rotate about pivot rod 199 to the display position. In certain embodiments, pivot rod 199 is a fixed rod and extends through moveable portion 192 such that the moveable portion rotates about the rod. In other embodiments, the pivot rod rotates along with the moveable portion. The pivot rod may be centrally positioned with respect to the moveable portion, such that the moveable portion pivots about it's center. In the observable or display position, display screen 182 may be rotated to a position substantially parallel with the top surface of the railing or an angled position with respect to the top surface. In certain embodiments, the display screen 182 is rotated to a position about 45 degrees from the top surface of the railing. The direction of movement of moveable portion 192 within the housing from the hidden position to the display position is represented by the M arrow.

In certain embodiments, the movement is caused by a force exerted on the moveable portion at or near corner 197 to cause the moveable portion to rotate about the rod. Both moveable portions 92 and 192 may be moved between the hidden and display positions via a motor and gears combination within the housings and/or the game table, as an example. However, it should be appreciated that other mechanisms to cause the movement are contemplated as would generally occur to one skilled in the art. In certain embodiments, a break-away clutch feature may optionally be incorporated into the gearing arrangement operable to move the movable portions. The optional break-away clutch feature may be configured to break-away, collapse or decouple when a force on the movable portion (when in the display position) exceeds a safety threshold and thereby allow the moveable portion to return to the hidden position within the housing. Such a feature prevents damage to the components when a force is exerted on the display screen or moveable portion, such as someone pushing on the moveable portion in an attempt to manually return it to the hidden position, as an example. In certain embodiments, after the moveable portion is forced to the hidden position, the display screen may continue to display the score and/or other game status indicators. In some embodiments, the moveable portion may remain in the hidden position until the game table power is turned off and then turned back on.

It is also contemplated that the moveable portion may be moveable, rotatable and/or extendable a further distance out of the housing than as illustrated in the figures. Moreover, it is contemplated that in certain embodiments, the moveable portion does not rotate with respect to the housing, but rather rises and falls to extend substantially straight out of the housing from a hidden position within the housing in response to a stimuli as discussed above.

In certain embodiments, the game table may optionally include a cover configured to be positioned at least over the display screen. In some embodiments, the cover may be positioned over the moveable portion and the flange or rim of the housing as well. The cover may be a removable cover which a user can take on and off as desired to reveal the display screen. In other embodiments, the cover may be integrated with the game table in a variety of possible ways. As an example, the cover could be a sliding cover which retracts within a slot in the railing when activated to reveal the display screen. In certain embodiments, the cover may be automatic in response to a stimuli, such as turning the electrical power of the game table on or off. In other embodiments, movement of the cover is manual.

As mentioned above, movement or rotation of moveable portion 92 and/or 192 may occur in response to activation of a stimuli, such as the game table power button. In the example of FIG. 1, the game table power is turned on and off by a user depressing button 62 on control pad 60. As another example embodiment, the game table may include a touch screen control panel, such as touch screen 182 on control pad 160, as illustrated in FIG. 4. A control pad having a touch screen for the game controls, such as control pad 160, may be included with a game table having a pop-up score display unit in lieu of a control pad having depressible buttons, such as control pad 60.

Control pad 160 includes one or more touch sensors corresponding to specific controls of for the game table. In certain embodiments, control pad 160 includes at least one touch sensor to control the on/off power setting of the game table, such as power control touch sensor 162. The control pad may include additional touch sensors as would generally occur to one skilled in the art. Example touch sensors are illustrated in FIG. 4 and include a restart touch sensor 164, a timing touch sensor 166, an air fan touch sensor 168, a sound touch sensor 170, and a start/stop touch sensor 172. As in the illustrated embodiment, each touch sensor may include some type of illustration or design as a symbol representing the associated control function, as well as one or more words describing the function. However, it should be appreciated that the touch sensors may be represented solely by symbols, solely by words, or by one or more other types of representation as would occur to one skilled in the art.

In embodiments having a touch sensor control pad, such as control pad 160, the pop-up score display unit, such as unit 80, is preferably electrically coupled with the on/off power touch sensor of the control pad, such as touch sensor 162, to activate movement or rotation of the display screen between a hidden position and a more visible or observable position to allow the players to more easily view the score of the game, as discussed above. In a particular embodiment, when a user presses touch sensor 162 to turn the power to the game table on, an electrical signal is sent which activates the moveable portion having the display screen to rotate up from the housing to the rotated position. Additionally, when a user presses touch sensor 162 to turn the power to the game table off, an electrical signal is sent which activates the moveable portion to rotate back into the housing to the hidden position, with the display screen being flush or substantially parallel with top surface 50*a* of railing 50.

In the illustrated embodiment, control pad 160 includes a rim or flange 191 surrounding touch screen 182 for mounting the control pad to the game table. As illustrated, flange 191 may define four corner mounting holes 195 configured to receive fasteners to mount the control pad. In some embodiments, control 160 may be a relatively thin panel configured to be positioned up against a railing or other portion of the game table. In other embodiments, control pad 160 includes a rear body portion or housing which is sufficiently deep or thick to necessitate at least partial insertion into a cavity formed in the game table, similar to the positioning of at least part of housing 90 within railing 50 as discussed above with respect to unit 80. However, it should be appreciated that the touch sensor control pad can be configured differently than as illustrated and can be mounted to the game table in a variety of possible manners and at a variety of possible locations as would generally occur to one skilled in the art.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. A game table, comprising:

a game table having a game playing surface and a railing;

wherein said railing extends around the perimeter of said game playing surface and extends at least slightly above said game playing surface to prevent escape of a game playing piece from said game playing surface, said railing having a top surface;

wherein said game table includes a triangular display block having only first, second and third sides with a display screen on said first side, wherein each of said sides is fixed in position relative to the other sides, said display block being at least partially mounted within said railing;

wherein said display screen is rotatable to raise said display screen from a flat position in which said display screen is positioned substantially parallel with said top surface of said railing to a raised display position in which said display screen is positioned at an oblique angle with respect to said top surface.

2. The game table of claim 1, wherein at said flat position, said display screen is substantially flush with said top surface of said railing.

3. The game table of claim 1, wherein at said flat position, said display screen is positioned within said railing below said top surface.

4. The game table of claim 1, wherein said game table includes a housing member non-movably mounted within said railing and said triangular display block is rotatably mounted within said housing and configured to at least partially project out of said housing.

5. The game table of claim 1, wherein said display position, said display screen is rotated to a position creating substantially a 45 degree angle between said display screen and said top surface.

6. The game table of claim 1, wherein said display screen is moveable between said flat and display positions in response to a stimuli, wherein said stimuli includes a power control mechanism operable to turn the electrical power of said game table on and off when triggered by a user, wherein said score display block is electrically coupled with said power control mechanism, wherein triggering said power control mechanism to turn the electrical power of said game table on causes said display screen to move to said open position.

7. The game table of claim 6, wherein said game table further includes a touch screen control panel having at least one touch sensor operable to activate a game table control feature, wherein said power control mechanism is represented by said at least one touch sensor.

8. A game table, comprising:

a game table having a game playing surface and a railing;

wherein said railing extends around the perimeter of said game playing surface and extends at least slightly above said game playing surface to prevent escape of a game playing piece from said game playing surface, said railing having a top surface;

wherein said game table includes a score display unit including a housing member non-movably mounted within said railing and a triangular display block pivotably mounted within said housing member, said display block having only first, second and third sides, with a display screen substantially occupying said first side, wherein each of said sides is fixed in position relative to the other sides;

wherein said display block is pivotable with respect to said housing to raise said display screen from an inset position within said housing to a raised display position with respect to said railing, wherein at said inset and display position, there is no appreciable gap between said display block and said housing member.

9. The game table of claim 8, wherein said housing member includes an upper flange mounted to said top surface of said railing.

10. The game table of claim 8, wherein said display member is configured to be pivotable in response to a change in the on/off electrical power status of said game table.

11. The game table of claim 10, wherein said game table further includes a touch screen control panel having at least one touch sensor operable to activate a game table control feature, wherein said at least one touch sensor is coupled to an on/off power control mechanism, wherein said on/off power control mechanism is electrically coupled with said score display unit.

12. The game table of claim 8, wherein at said inset position, said display screen is positioned substantially parallel and flush with said top surface of said railing.

13. The game table of claim 8, wherein at said display positions, said display screen is positioned at substantially a 45angle with respect to said top surface of said railing.

14. A game table, comprising:

a game table having at least one surface;

wherein said game table includes a game status display unit pivotably mounted in said surface;

wherein said game status display unit is a triangular display block having only first, second and third sides, with a display screen on said first side, wherein each of said sides is fixed in position relative to the other sides, wherein the triangular display block is rotatable from a first storage position where said display screen is positioned parallel and flush with said surface to a second raised display position where said display screen projects above said surface.

15. The game table of claim 14, wherein said game table includes a railing extending around the perimeter of and slightly above said game playing surface, said railing having a top surface, wherein said game table surface is said top surface of said railing.

16. The game table of claim 15, wherein said game table includes a housing member for said game status display unit, said housing member being mounted within said railing.

17. The game table of claim 16, wherein said game status display unit is pivotable within said housing via a pivot rod connecting said games status display unit with said housing.

18. The game table of claim 14, wherein said second raised display position includes said display screen raised to a position creating substantially a 45 degree angle between said display screen and said game table surface.

19. The game table of claim 8, wherein said triangular display block includes a back surface occupying said second side and a top edge occurring between said first and second sides, wherein at said display position, said back surface extends from said top edge to adjacent said housing member such that there is no appreciable gap between said display block and said housing member.

20. The game table of claim 16, wherein at said first storage position and said second raised display position, there is no appreciable gap between said game status display unit and said housing member.

* * * * *

UNITED STATES PATENT AND TRADEMARK OFFICE

CERTIFICATE OF CORRECTION

PATENT NO. : 8,376,870 B2
APPLICATION NO. : 12/202785
DATED : February 19, 2013
INVENTOR(S) : Safari Chung It is certified that error appears in the above-identified patent and that said Letters Patent is hereby corrected as shown below:

In the Claims
In column 9, line 20, replace “position” with --positions--.
In column 9, lines 26-27, replace “member” with --block--.
In column 10, line 24, replace “games” with --game--.

Signed and Sealed this
Eighteenth Day of June, 2013

Teresa Stanek Rea
*Acting Director of the United States Patent and Trademark Office*